US007182631B2

(12) United States Patent
Kollmann

(10) Patent No.: US 7,182,631 B2
(45) Date of Patent: Feb. 27, 2007

(54) BRIDGING MEMBER FOR ELECTRICAL TERMINALS

(75) Inventor: Hans-Josef Kollmann, Minden (DE)

(73) Assignee: WAGO Verwaltungsgesellschaft mbH (DE)

( * ) Notice: Subject to any disclaimer, the term of this patent is extended or adjusted under 35 U.S.C. 154(b) by 0 days.

(21) Appl. No.: 11/105,780

(22) Filed: Apr. 13, 2005

(65) Prior Publication Data

US 2005/0233634 A1 Oct. 20, 2005

(30) Foreign Application Priority Data

Apr. 14, 2004 (DE) ..... 10 2004 018 554

(51) Int. Cl.
*H01R 31/08* (2006.01)

(52) U.S. Cl. ..... 439/511

(58) Field of Classification Search ..... 439/510, 439/511, 516, 248; 339/64, 17 LC
See application file for complete search history.

(56) References Cited

U.S. PATENT DOCUMENTS 3,308,422 A * 3/1967 Boysen ..... 439/43
3,864,000 A * 2/1975 Coller et al. ..... 439/246
4,029,376 A * 6/1977 Headington et al. ..... 439/510
4,553,802 A * 11/1985 Ruehl ..... 439/266
5,000,699 A * 3/1991 Nadin ..... 439/511
5,061,196 A * 10/1991 Weston et al. ..... 439/189
5,201,667 A * 4/1993 Endo et al. ..... 439/189
5,816,851 A * 10/1998 Cheng et al. ..... 439/510
6,447,331 B1 * 9/2002 Fukatsu et al. ..... 439/516
6,835,079 B2 * 12/2004 Gentry et al. ..... 439/188

FOREIGN PATENT DOCUMENTS

DE 42 01 219 7/1993
DE 42 23 540 1/1994
DE 44 11 306 5/1995
DE 197 08 649 8/1998

* cited by examiner

*Primary Examiner*—Tulsidas C. Patel
*Assistant Examiner*—Harshad C Patel
(74) *Attorney, Agent, or Firm*—Salter & Michaelson

(57) ABSTRACT

A bridging member for electrical terminals provides each of the connecting pins of the bridging member with a sleeve of insulating material, which extends in the axial direction around the connecting pin in such a way that an inner free space is present between the connecting pin and the sleeve of insulating material, whereby the connecting pin possesses a material constriction in the depth of the sleeve of insulating material. The connecting pin can execute equilibrating movements in the free space of the sleeve of insulating material and also can be removed from the sleeve of insulating material by means of a rotational movement.

10 Claims, 1 Drawing Sheet

BRIDGING MEMBER FOR ELECTRICAL TERMINALS

TECHNICAL FIELD

The invention concerns a crossbridging member for electrical terminals which are disposed adjacent to one another in a row, such as, e.g. series terminals which are arranged in a row one after the other on a mounting bus.

BACKGROUND DISCUSSION

It is known to provide the current bus of the terminals with connector receptacles, which are positioned centrally symmetric to a common plane of connector receptacles which extends in the direction of the row of terminals. This connector receptacle plane in the usual case runs in a so-called "bridging shaft", which is formed constructively in the housings of insulating material for the terminals in the row arrangement.

The bridging members are produced as multiple bridging members, i.e., they possess two or more connecting pins which extend but away from the bridge head of the bridging member like a comb and are centrally symmetric to a common comb extension plane, whereby the comb extension plane is equally covered when the bridging member is plugged into the connector receptacle plane of the terminals.

The bridge head of the bridging member is protected by isolating it by means of insulating material.

In the common connector receptacle plane of the terminals arranged in a row, it is also possible and known to bridge gaps, e.g., by means of a bridging member, in which a central connecting pin is broken away at a break-off site, so that the terminal lying thereunder in the terminal arrangement is skipped over by means of such a modified bridging member.

In the case of current bridges employing the known bridging members, problems may occur when the manufacturing tolerances are not maintained for the individual terminals or when relative displacements occur within an arrangement of terminals in a row next to one another, e.g., as a consequence of fairly large tensile forces on the conductor or as a consequence of other forces acting on individual or adjacent terminals, by which means, their current-bus connector receptacles may be moved out of the common connector receptacle plane of the terminal arrangement.

These possible tolerance inaccuracies and relative shifts can cause a weakening of the contact force and thus a weakening of the current transfer between connecting pins and the current bus in the "connecting pin/connector receptacle" contact system, in particular, when the bridging member with its connecting pins is a stiff punched-out part and the connector receptacles in the current buses are formed as spring-loaded connector receptacles (e.g., as externally spring-loaded connector sockets). In such a case, the possible tolerance inaccuracies and relative shifts may be directed against the spring force of the spring-loaded connector receptacle, which is usually subjected to a prestress, so that the connecting pin is not pressed with the necessary contact force against the contact bearing surface of the current bus when the bridging member is plugged in.

SUMMARY OF THE INVENTION

The object of the invention is to avoid this endangering of the electrical contact security between the bridging-member connecting pins and the connector receptacles of the current buses and to develop a "connect pin/connector receptacle" contact system, which assures a continually sufficient electrical contact security even in cases of possible tolerance inaccuracies and relative shifts in the arrangement of terminals arranged in a row next to one another.

This object is solved according to the invention in that a sleeve of insulating material is formed starting from the insulating material of the bridge head of the bridging member for each connecting pin of the bridging member, and this sleeve extends in the axial direction around the connecting pin in such a way that between the connecting pin and the sleeve of insulating material an inner free space is present and that the connecting pin has a material constriction (=a material weak spot) inside the sleeve of insulating material and at a distance to the open end of the sleeve of insulating material, whereby the free space of the sleeve of insulating material around the connecting pin is dimensioned such that the free end of the connecting pin can execute a pivoting and/or rotational movement around the material constriction.

The teaching of the invention contains several advantages.

Named as a first advantage is the fact that the connecting pins of the bridging member can execute an equilibrating movement in a type of "pendulum swing" for the case when tolerance inaccuracies and/or relative shifts of individual terminals in a row arrangement of terminals require this. This is true even when the bridging member is manufactured as a low-cost, punched-out part and its material in fact possesses good electrical conductivity, but has only small elastic deformation properties. The possibility of adapting and equilibrating inaccuracies and shifts in the "connecting pin/connector receptacle" contact system according to the invention is essentially achieved only by the material constriction (=material weak spot) of the material of the bridging-member connecting pins in combination with the free space, which surrounds the connecting pins in the insulating sleeves, whereby it is advantageous to select the position of the material constriction in the depth of the sleeve of insulating material and in the vicinity of the bridge head of the bridging member, in order to maintain as small as possible the forces which are triggered and which must act on the free end of the connecting pin in order to carry out the equilibrating movements.

Another advantage of the invention is produced from the free space, which is formed inside the sleeve of insulating material that surrounds each connecting pin, between the sleeve of insulating material and the metal of the connecting pin, whereby in an advantageous manner, the open end of the sleeve of insulating material can be guided up to the vicinity of the current-bus connector receptacle of the respective terminal when the bridging member is plugged in.

The creep and air gaps between adjacent bridging-member connecting pins conducting different electrical potentials are considerably improved by this measure. This neighboring situation of differing electrical potentials is often encountered between the connecting pin of one bridging member on the end side and the end-side connecting pin of an adjacent plugged-in bridging member in row arrangements of terminals, when the two bridging members conduct different electrical potentials.

Another essential advantage of a bridging member according to the invention concerns its applicability to provide bridging members with gaps in row arrangements of terminals. To produce gaps, as is known, one or more connecting pins is removed from the bridging comb of a bridging member. In the case of a bridging member according to the invention, this gap is produced by grasping with tweezers the outer free end of a connecting pin, which projects out of the sleeve of insulating material that surrounds the connecting pin and removing the pin by vigorous rotating movements of the connecting pin around its material constriction (=a material weak spot, which serves in this case as a break-off site). Then the empty sleeve of insulating material remains in its entire depth or in its entire length, preferably if the material constriction is positioned in the depth of the sleeve of insulating material in the vicinity of the bridge head of the bridging member.

If the entire depth of the empty sleeve of insulating material remains, this will considerably improve the creep and air gaps between the skipped-over current bus of a terminal and the bridge head of the bridging member in the region where the gap is bridged, so that gap bridgings are possible with high current intensities.

DETAILED DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 6:
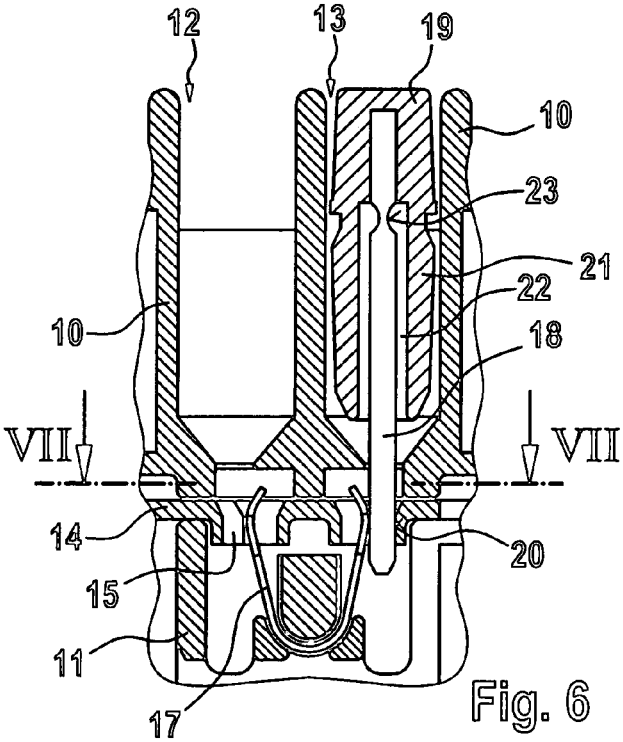
FIGS. 6 and 7 show a use situation conforming to practice of a bridging member according to the invention.

The excerpt shown in FIG. 6 shows a cross section through the housing of insulation material 10, 11 of a series terminal, which has two bridging recesses of shafts 12 and 13, each of which extends in the direction perpendicular to the plane of the drawing over several series terminals arranged in a row next to each other in a row arrangement of terminals. In FIG. 6, a bridging member 19 occupies only the right bridging shaft 13; the left bridging shaft is empty.

Figure 7:
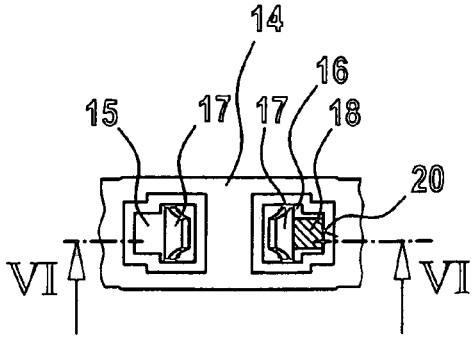

A current bus 14 is disposed in the housing of insulating material of the series terminals and fixed in position. It possesses two connector receptacles 19 and 16 (see also for this the top view onto the current bus 14 in FIG. 7). The connector receptacles are spring-loaded by means of the spring 17 bent in U-shape. The U-shaped spring 17 is inserted pre-tensed in the connector receptacles and has the task of pressing the connecting pin 18 of the bridging member 19 plugged into the right bridging shaft 13, in a manner that produces secure contact, against the contact bearing surface 20 of the current bus 14.

In order to assure this reliability of contact for all contact connections of "connecting pins/connector receptacles" of a bridging member, wherein the latter must be constructed, e.g, as an eight-member bridging member (i.e., with eight connecting pins) in a segment of corresponding size in a row arrangement of terminals, it is provided according to the invention to position each individual connecting pin 18 in a sleeve of insulating material 21, which surrounds the connecting pin but leaves a free space 22 for it, so that the pin can execute an equilibrating movement around its material constriction 23 in a type of pendulum swing which may be required if tolerance inaccuracies and/or relative shifts of individual terminals occur in the segment that is found in a row arrangement of terminals.

Figure 4:
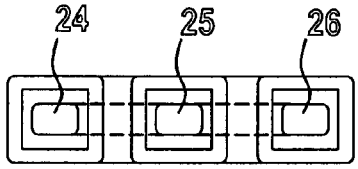
FIGS. 4 and 5 show bottom views of the above-named bridging member.
Figure 1:
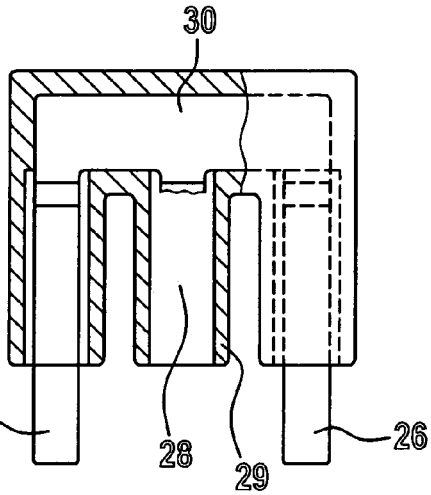
FIGS. 1 to 3 show a longitudinal section and two cross sections through a triple bridge.
Figure 2:
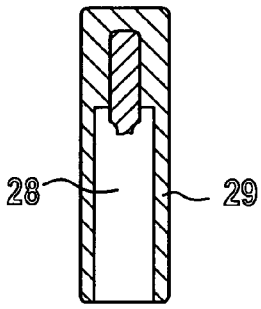
Figure 3:
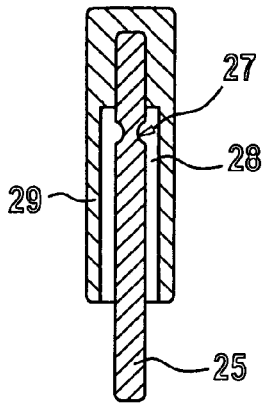

FIG. 4 shows the bottom view of a triple bridging member, and FIG. 1 shows the longitudinal section of this bridging member, which initially possessed three connecting pins 24 to 26 (see FIG. 4) and then the central connecting pin 25 was removed from it (see FIG. 1). FIG. 3 shows in cross section the central part of the bridging member before removing the connecting pin 25, and FIG. 2 shows in cross section the central part of the bridging member after removing the connecting pin.

Figure 5:
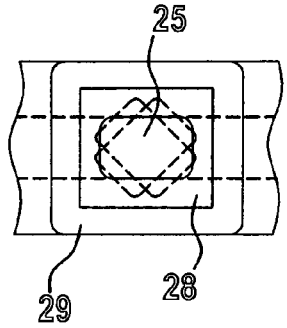

The connecting pin is removed by vigorous rotational movements of the connecting pin 25 around its material constriction 27, which serves in this case as the break-off site. FIG. 5 shows the rotational movements of the connecting pin 25 that are to be conducted in the free space 28 inside the sleeve of insulating material 29.

After removal of the connecting pin, a completely empty free space 28 remains in the sleeve of insulating material 29, and the free space extends over the entire depth or over the entire axial length of the sleeve of insulating material, so that the creep and air gaps between the bridge head 30 of the bridging member and another electrical potential that may be present on the lower open end of the sleeve of insulating material are improved in such a way that gap bridgings are possible even with high current intensities by employing the bridging member shown in FIG. 1.

While this disclosure has been particularly shown and described with references to preferred embodiments thereof, it will be understood by those skilled in the art that various changes in form and details may be made therein without departing from the spirit and scope of the disclosure as defined by the appended claims.

The invention claimed is:

1. A cross bridging member for electrical terminals, which are arranged in a row adjacent to one another comprising:

current buses of the terminals that include connector receptacles, into which connecting pins of the cross bridging member can be plugged, the connector receptacles of the terminals arranged in a row next to one another are positioned centrally symmetric to a common connector receptacle plane, which extends in the direction of the row of terminals, the cross bridging member possesses a bridge head and two or more connecting pins which are electrically connected and extend out as a comb from the bridge head and are centrally symmetric to a common comb extension plane, wherein the comb extension plane is equally covered when the cross bridging member is plugged into the connector receptacle plane of the terminals, the bridge head of the cross bridging member is protected by means of insulating material, is hereby characterized in that, proceeding from the insulating material of the bridge head for each connecting pin of the cross bridging member, a sleeve of insulating material is formed, which extends in the axial direction around the connecting pin in such a way that an inner free space is present between the connecting pin and the sleeve of insulating material, that the connecting pin has a material constriction inside the sleeve of insulating material and at a distance from the open end of the sleeve of insulating material, that the free space of the sleeve of insulating material around the connecting pin is dimensioned such that the free end of the connecting pin can execute a pivoting and/or rotational movement around the material constriction, and that the connector receptacle includes a resilient spring disposed at a free end of the connecting pin on one side thereof and a fixed bearing surface disposed opposite to said resilient spring on the opposite side of said connecting pin so that when the connecting pin is inserted into said receptacle a secure contact is produced by the resilient spring urging the connecting pin against the bearing surface.

2. The cross bridging member according to claim 1, further characterized in that the material constriction of the connecting pin is positioned in the depth of the sleeve of insulating material in the vicinity of the bridge head of the cross bridging member.

3. The cross bridging member according to claim 1, further characterized in that the open end of the sleeve of insulating material of the cross bridging member, when the cross bridging member is plugged in, extends up to the vicinity of the current-bus connector receptacle of the respective terminal.

4. A bridging member including an electrical receptacle comprising:

a bridge head;

at least one connecting pin for receipt in said electrical receptacle;

said at least one connecting pin extending from said bridge head to a free end thereof;

an insulating sleeve for receiving said connecting pin and extending about the connecting pin to define an inner free space therebetween;

said connecting pin having a material constriction inside the insulating sleeve and at a distance from the free end of said connecting pin;

the defined inner free space being dimensioned such that the free end of the connecting pin can pivot and/or rotate about the material constriction, and that the electrical receptacle includes a resilient spring disposed at a free end of the connecting pin on one side thereof and a fixed bearing surface disposed opposite to said resilient spring on the opposite side of said connecting pin so that when the connecting pin is inserted into said receptacle a secure contact is produced by the resilient spring urging the connecting pin against the bearing surface.

5. The bridging member according to claim 4 wherein the material constriction of the connecting pin is positioned within the sleeve in the vicinity of the bridge head.

6. The bridging member according to claim 4 wherein the material constriction is in the form of a reduced diameter.

7. The bridging member according to claim 4 wherein the insulating sleeve has an open end whereby, when the bridging member is plugged in, the open end extend up to the vicinity of the electrical receptacle.

8. The bridging member according to claim 4 wherein said electrical receptacle includes a housing of insulation material having defined therein at least one recess shaft for receiving therein said insulating sleeve and connecting pin, and the receptacle housing having a port of a diameter greater than the diameter of the connecting pin so as to enable said pin pivoting.

9. A cross bridging member for insertion in connector receptacles arranged in the busbars of terminal blocks disposed directly adjacent to one another;

the bridging member comprising;

a bridge head;

at least three connecting pins, each extending from said bridge head to a free end thereof for receipt in said connector receptacles;

each connecting pin has a material constriction in the form of a reduced diameter serving as a break-off site, which is positioned in the vicinity of the bridge head;

each connecting pin is surrounded with a sleeve of insulating material proceeding from the insulation material of the bridge head and extending in the axial direction around the connecting pin up to the vicinity of the busbar, in which the connector receptacle of the respective terminal block is arranged;

each insulating sleeve defines an inner free space between the inner surface of said sleeve and the outer surface of the connecting pin such that the free end of the connecting pin can be grasped with a tool and can be removed by vigorous rotating movements of the connecting pin around its material constriction without damaging the insulating sleeve which remains in its entire length.

10. A bridging member including an electrical receptacle and comprising:

a bridge head;

at least one connecting pin for receipt in said electrical receptacle;

said at least one connecting pin extending from said bridge head to a free end thereof;

an insulating sleeve for receiving said connecting pin and extending about the connecting pin to define an inner free space therebetween;

said connecting pin having a material constriction inside the insulating sleeve and at a distance from the free end of said connecting pin;

the defined inner free space being dimensioned such that the free end of the connecting pin can pivot and/or rotate about the material constriction, wherein said electrical receptacle includes a housing of insulation material having defined therein at least one recess shaft for receiving therein said insulating sleeve and connecting pin, and the receptacle housing having a port of a diameter greater than the diameter of the connecting pin so as to enable said pin pivoting.

* * * * *